US005955175A

United States Patent [19]

Culler

[11] Patent Number: 5,955,175

[45] Date of Patent: Sep. 21, 1999

[54] INFRA-RED REFLECTIVE COVERINGS

[75] Inventor: Gregory D. Culler, Nottingham, Pa.

[73] Assignee: W. L. Gore & Associates, Inc.

[21] Appl. No.: 08/751,288

[22] Filed: Nov. 18, 1996

Related U.S. Application Data

[63] Continuation of application No. 08/707,997, Sep. 20, 1996, abandoned.

[51] Int. Cl.[6] ..... B32B 3/10; B32B 15/08; E04H 15/14

[52] U.S. Cl. ..... 428/209; 2/904; 2/DIG. 1; 135/93; 428/306.6; 428/308.4; 428/318.4; 428/319.3; 428/422; 428/461; 442/230; 442/379

[58] Field of Search ..... 442/230, 379; 428/209, 306.6, 308.4, 422, 318.4, 457, 319.3, 461, 319.7; 2/1, 904, DIG. 1; 135/93

[56] References Cited

U.S. PATENT DOCUMENTS

| | | | |
|---|---|---|---|
| 4,064,305 | 12/1977 | Wallin . | |
| 4,194,041 | 3/1980 | Gore et al. | 442/289 |
| 4,308,882 | 1/1982 | Pusch et al. . | |
| 4,465,731 | 8/1984 | Pusch et al. . | |
| 4,467,005 | 8/1984 | Pusch et al. . | |
| 4,495,239 | 1/1985 | Pusch et al. . | |
| 4,508,775 | 4/1985 | Adiletta . | |
| 4,508,776 | 4/1985 | Smith . | |
| 4,510,194 | 4/1985 | Miyake et al. | 428/212 |
| 4,529,633 | 7/1985 | Karlsson . | |
| 4,533,591 | 8/1985 | Sorko-Ram . | |
| 4,557,957 | 12/1985 | Manniso . | |
| 4,621,012 | 11/1986 | Pusch . | |
| 4,659,602 | 4/1987 | Birch . | |
| 5,024,594 | 6/1991 | Athayde et al. . | |
| 5,209,965 | 5/1993 | Caldwell . | |
| 5,230,430 | 7/1993 | Kidder . | |
| 5,281,460 | 1/1994 | Cox . | |
| 5,408,782 | 4/1995 | McConnell . | |

FOREIGN PATENT DOCUMENTS

| | | |
|---|---|---|
| 0361865 | 4/1990 | European Pat. Off. . |
| 0 615779A1 | 9/1994 | European Pat. Off. . |
| 2612948 | 3/1987 | France . |
| WO 88/05385 | 7/1988 | WIPO . |
| WO 93/08019 | 4/1993 | WIPO . |
| WO 95/05792 | 3/1995 | WIPO . |
| WO 96/32252 | 10/1996 | WIPO . |

*Primary Examiner*—Marion E. McCamish
*Assistant Examiner*—Blaine R. Copenheaver
*Attorney, Agent, or Firm*—Gary A. Samuels

[57] ABSTRACT

A textile material having thermal image masking or suppression in the mid and far infra-red region without compromising the effectiveness of visual and near IR camouflage or comfort level, or the effectiveness, and mobility of a person. Specifically the invention is directed to an air permeable, moisture vapor transmissive, waterproof, heat reflecting material consisting essentially of at least one metallized microporous membrane, with an oleophobic coating over the metallized portions thereof. This membrane is laminated to at least one other layer or textile backing material such as woven, nonwoven or knitted nylon, polyester, cotton, silk, etc. or additional microporous layers, in which the metal in the metallized membrane forms a discontinuous layer on the surface and on the pore walls adjacent the surface of the microporous membrane.

8 Claims, 2 Drawing Sheets

INFRA-RED REFLECTIVE COVERINGS

CROSS-REFERENCE TO RELATED APPLICATIONS

This application is a continuation of application Ser. No. 08/707,997, filed Sep. 20, 1996, now abandoned.

FIELD OF THE INVENTION

This invention relates to electromagnetic reflective and transmissive materials and to the use of the materials as electromagnetic camouflage, particularly at infra-red wavelengths.

BACKGROUND OF THE INVENTION

Instruments which detect thermal radiation are well known. Radiation from the human body or from other objects can easily be detected by infra-red detecting instruments.

These instruments operate in the atmospheric transparency windows of 3 to 5 micrometers and 8 to 12 micrometers. Infra-red imaging at wavelengths outside of these windows is not practical due to atmospheric absorption. In images obtained with these devices, objects with high emissivities and objects having a higher temperature relative to the background appear as bright silhouettes. This is due to the emitted power of these objects. The emitted power is described by the equation:

$$W=\epsilon\sigma T^4$$

where W=emitted power in BTU/hr.-ft.$^2$ $\epsilon$=emissivity, $\sigma$=the Stephan-Boltzman constant, and T=temperature in degrees Rankine.

From this equation it can be seen that there are two possible approaches to subdue a thermal image: use low emissivity materials on the exterior surface or reduce the exterior surface temperature. The typical approach is to use low emissivity materials on the exterior surface and then to cover the low emissivity surface with materials which are transparent in infrared (IR) wavelengths but optically opaque to provide visual camouflage. The second approach is to use thermal insulation to reduce the exterior surface temperature. Another option is a combination of these methods.

It has long been a desirable goal to develop materials that protect personnel or equipment from detection by electromagnetic, and especially infra-red, detecting equipment without detracting from the mobility of the personnel or equipment.

For example, U.S. Pat. No. 5,281,460 issued to Cox provides a pattern of strips attached to a porous nylon mesh. The strips are coated with silver, copper, or pigment.

U.S. Pat. No. 4,495,239 issued to Pusch et al. employs a base layer of textile fabric having a vapor deposited metallic reflecting layer on it, followed by a camouflage paint.

U.S. Pat. No. 4,659,602 issued to Birch employs a woven material that has a metal foil on it and a polyethylene sheet containing a conductive particulate.

In U.S. Pat. No. 4,621,012 issued to Pusch, a textile is coated with a thermoplastic that has selected dipole material in it. The material has a metallic layer to reflect infra-red.

U.S. Pat. No. 4,467,005 issued to Pusch et al. employs a support netting with a carrier web on each side having an infra-red reflecting metal coating. The material is water vapor permeable.

U.S. Pat. No. 4,533,591 issued to Sorko-Ram provides a thermoplastic resin having discrete electromagnetic particles dispersed in it.

U.S. Pat. No. 4,064,305 issued to Wallin provides a knit formed of strands of noncontinuous polymeric fibers and noncontinuous metal fibers which reflect radar waves.

U.S. Pat. No. 4,529,633 issued to Karlsson teaches an electromagnetic reflecting material made of a layer of polyethylene, a layer of a metal coating, an adhesive, and a fabric.

Because of the presence of plastic layers, the compositions of the patents do not allow water vapor to escape easily and, when worn as garments, are uncomfortable or when draped over equipment cause "sweating" of the equipment. One exception is U.S. Pat. No. 4,467,005 which claims water-vapor permeability, but not air permeability. However, to a person skilled in the art it is readily apparent that the technique described to achieve water vapor permeability and waterproofness would not result in a sufficiently high water vapor permeability to be of any practical value. Any improvements in water vapor permeability would result in a corresponding reduction in waterproofness. The materials described in the aforementioned patent provide a satisfactory surface for metallization and are acceptable for uses where a high degree of flexibility and mobility are not required, such as a covering for stationary objects, but many disadvantages surface when these materials are used to provide thermal imaging protection for an individual person. Chief among these disadvantages are the lack of drape, low moisture vapor permeability, and weight. In addition to the aforementioned disadvantages, the metallized surface is on the exterior of the laminates where it is in a position to be damaged or scraped off while moving through brush.

It is desirable from a physiological standpoint to reduce the heat stress of the person wearing infra-red camouflage garments to the largest extent possible. This can be accomplished by increasing the evaporative cooling of the body by allowing moisture vapor to easily permeate through the laminate, and by reducing weight and thickness of the total thermal camouflage package.

Another exception is disclosed in U.S. Pat. No. 4,557,957 issued to Manniso which teaches a hydrophilic metal coating on microporous expanded polytetrafluoroethylene membranes. Although laminates constructed using the coated membrane described in this patent offer some advantage in thermal and physiological performance over the other materials described above, it would not be sufficiently waterproof to be of any practical value. As a result, the metal layer as disclosed by this reference is subject to corrosion and abrasion.

SUMMARY OF THE INVENTION

The present invention provides an infra-red reflective material, which can be made into a typical article of clothing or used to cover objects such as tents and which can be used for thermal image masking or suppression in the mid and far infra-red region without compromising the effectiveness of visual and near IR camouflage or the comfort level, effectiveness, and mobility of a person. This material includes a metallized layer and an oleophobic coating on the metallized layer. The incorporation of a metallized microporous membrane into an article of clothing or a covering suppresses thermal imaging of objects underneath or behind the metallized membrane. By incorporating an additional oleophobic coating to cover the metallized layer, the metal is protected from wear and chemical attack.

Specifically, the invention is directed to an oleophobic, air permeable, moisture vapor transmissive, water resistant, drapeable, image-suppressing or infra-red reflecting material comprising at least one metallized microporous membrane laminated to at least one other layer or textile backing material such as woven, nonwoven, or knitted polyamides, polyolefins, polyester, cotton, silk, and the like or additional microporous layers. The metal in the metallized membrane forms a discontinuous layer on the surface and on the pore walls adjacent the surface or surfaces of the microporous membrane. A coating of an oleophobic material covers the metallized surface.

DESCRIPTION OF THE DRAWINGS

The invention is best understood from the following detailed description when read in connection with the accompanying drawing, in which.

DETAILED DESCRIPTION OF THE INVENTION

Figure 1A:
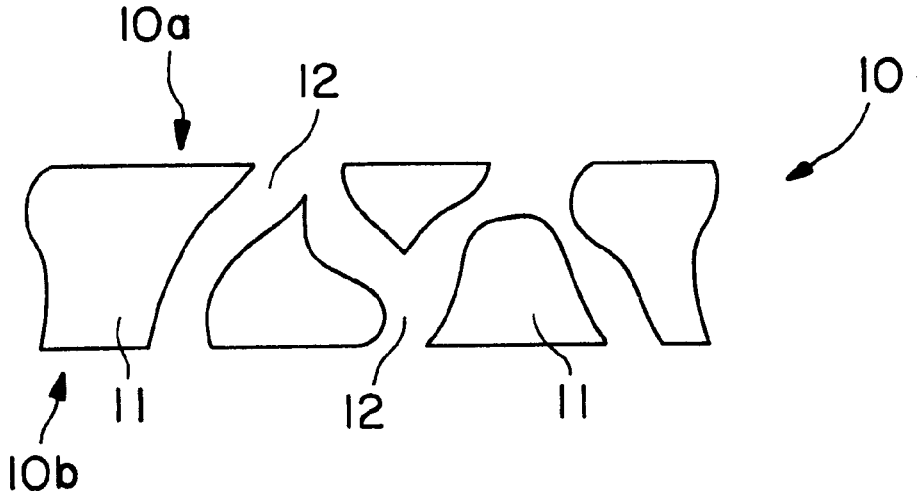
FIG. 1A is a cross-sectional view of a microporous membrane used in the present invention having irregularly shaped pores extending continuously from the top surface to the bottom surface.

Referring now to the drawings, wherein like reference numerals refer to like elements throughout, FIG. 1A shows a cross-sectional view of a microporous membrane 10 having a top surface 10*a*, a bottom surface 10*b*, and discontinuous polymer portions defining pores 12 therebetween. By "microporous" is meant a membrane material having structural integrity but also having microsize discontinuities throughout the structure thereof, which discontinuities provide pores or passageways extending from one outer surface of the membrane to the other. Moreover, the dimensions of these pores or passageways are such that, taken together with the surface characteristics of the material of construction of which the membrane is comprised, the pores or passageways are transmissive of air and water vapor but non-transmissive of liquid water. One such microporous membrane is a stretched PTFE fabric material available under the registered trademark GORE-TEX® membrane of W. L. Gore & Associates, Inc. of Newark, Del.

Figure 1B:
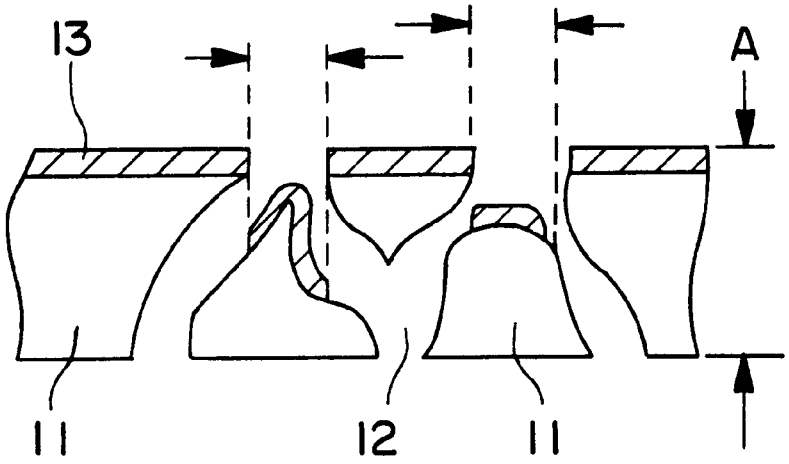
FIG. 1B is a cross-sectional view of the microporous membrane of FIG. 1A having a vapor deposited metal coating.

The pores 12 of the microporous membrane 10 are irregularly shaped and extend continuously from the top surface to the bottom surface such that the polymeric membrane is air-permeable, liquid moisture vapor permeable, liquid-waterproof (i.e. nontransmissive to liquid water), and drapeable. In FIG. 1B, a vapor deposited metal coating 13 is shown in which the metal is deposited on the top surface of the membrane i.e. the metal coats the top surface and the "open" pore walls, i.e., the portions of the pore walls that either comprise the top surface or exposed sub-surfaces, i.e. those sub-surfaces which are open (exposed) as viewed from the top surface of the membrane. Thus, looking vertically down on the top surface, the metal coating 13 forms continuous line-of-sight coverage as depicted by the dotted lines in FIG. 1B. From the side, it is seen that the metal coating is discontinuous, leaving the pores open for passage of water vapor, while covering the top surface and exposed sub-surface portions thereof.

Figure 1C:
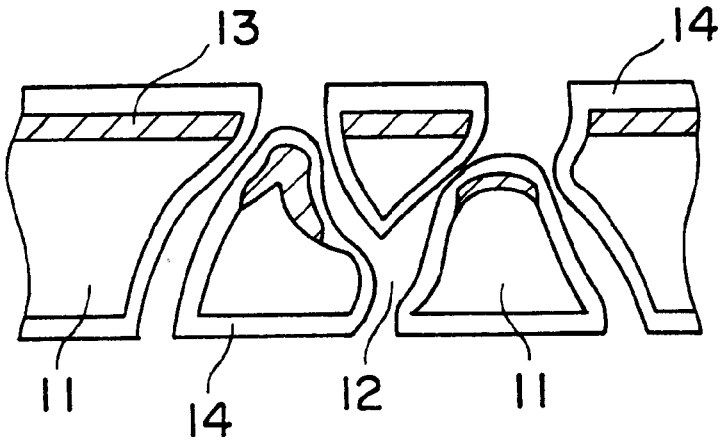
FIG. 1C is a cross-sectional view of the metallized microporous membrane of FIG. 1B having an oleophobic coating deposited thereon.

FIG. 1C shows an oleophobic coating 14 on the surfaces of polymeric particles 11 and the walls of pores 12 of the microporous membrane 10. At a minimum, the oleophobic coating should cover at least the underlying metallized coating. In the embodiment of FIG. 1C, however, the oleophobic coating 14 not only completely covers and isolates the metal coating 13 from the pores 12 of the microporous membrane, but as seen from the side, the oleophobic coating 14 also covers all of the surfaces and pore walls of the membrane, while still leaving the pores 12 open for passage of air and water vapor.

The use of oleophobic metallized microporous films and membranes, such as microporous polyethylene, polypropylene, polyurethane, expanded polytetrafluoroethylene, and the like, which may be laminated with standard textile fabric backing materials, circumvents the disadvantages of the prior art for several reasons. First, the oleophobic treatment protects the metal layer from oxidation and allows metallization of either one or both membrane surfaces or even throughout the porous membrane structure. Moreover, this can be accomplished without compromising the waterproofness of the membrane. Second, the three-dimensional nature of the microporous material provides for 100% line-of-sight metal coverage on the surface as viewed from above, providing the IR reflection required for adequate thermal image suppression. Third, the porosity in three dimensions required to allow large quantities of moisture vapor to permeate through the composite is preserved, thus reducing heat stress on the wearer. Fourth, the air in the micropores of the membrane reduces the thermal conductivity of the membrane by providing an insulating air space. This forces more of the heat exchange between a human body and the environment to be through evaporative cooling. A large portion of the heat radiated through the microporous membrane from the body is reflected back towards the body, in turn reducing the temperature of the exterior surface, thereby reducing the thermal image. The reflected heat is removed through the body's natural cooling mechanism, evaporation. These thin, microporous materials are also lighter, more flexible and drapeable than materials cited in the prior art, which makes them more suitable for clothing.

As indicated above, the metallization is typically on one side only, but can be on both sides or throughout the structure of the membrane. The metallization can be applied to the membrane using a number of coating techniques including physical vapor deposition by, for example, sputter coating, chemical vapor deposition, electroless plating or by other known coating techniques. The metal coatings can range from 40 to 1200 angstroms in thickness on the nodes and fibrils, and the metallized membrane will have an optical density between 1 to 6 density units. The emissivity of the metal coating can range from 0.06 to 1, depending on the desired thermal performance. If a high degree of reflectance is desired, a low emissivity coating is required. On the other hand, if a large degree of absorbance is desired, a high emissivity coating would be required.

The metallized microporous film or membrane thickness shown as dimension "A" in FIG. 1B can range from 0.001 to 0.125 inches and will vary depending on the desired air and moisture vapor permeability. The thickness of the metal coating is not so great as to close the pores of the microporous film or membrane; rather, deposition takes place to the extent that the surface and part of the pore walls are covered to form a line-of-sight coating, as explained above with reference to FIG. 1B.

The metal used in the metallized microporous films and membranes can be any metal that can be vapor deposited or sputtered on the film or membrane and produce the desired reflective effect, such as aluminum, silver, copper, zinc, or the like—or any combination of those metals. Preferably, the microporous membrane 10 is expanded polytetrafluoroethylene (ePTFE) and the metal coating 13 is made of a material which contains aluminum.

The oleophobic coating 14 is typically applied after the metallization process is complete. Essentially any oleophobic material can be used so long as it tends to repel oil, and so long as it can be deposited on the metallized coating to render the surface thereof oleophobic while not significantly reducing the porosity of the underlying membrane. The types of oleophobic coatings which may be used include coatings of perfluoropolyethers; acrylate or methacrylate polymers or copolymers that have fluorinated alkyl side chains depending from the polymer's backbone, which side chains have a —CF3 terminal group, for example:

$$—(CH_2—CR)—COO—(CH_2)_n—(CF_2)_m—CF_3;$$

fluoroalkylacryl methanes, fluoroalkyl allyl urethanes, fluoroalkyl maleic acid esters.

Preferably the polymer will be an organic polymer that has the aforesaid fluorinated alkyl side chains in the recurring units. The oleophobic coating is preferably applied using film coating techniques such as, Maier rod, kiss roll, pad coating, and spray coating. Typically the oleophobic coating 14 is applied to an add-on weight of 5–50% of the base membrane, but preferably it is applied to an add-on weight of between about 12 and 25%. Preferably the oleophobic coating 14 is produced by brush coating an aqueous fluoroacrylate microemulsion coating over the metallized coating, drying the microemulsion coating, and then curing the microemulsion coating by heating.

Figure 2:
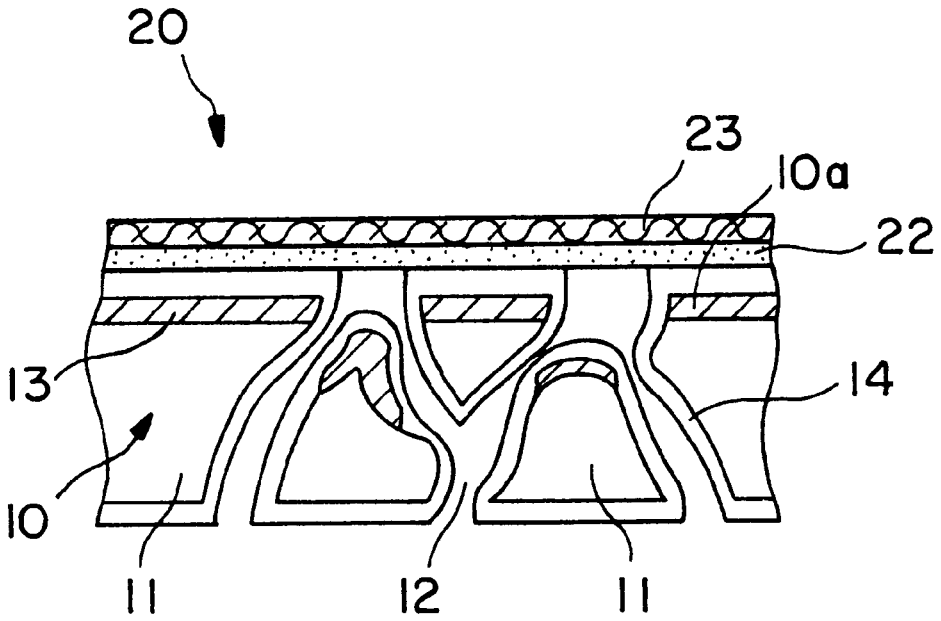
FIG. 2 is a cross-sectional view of the oleophobic metallized membrane of FIG. 1C which has an oleophobic overcoat and is laminated to a backing material.

In FIG. 2 there is shown an embodiment of the present invention comprising a laminated article 20 consisting of a microporous membrane 10, formed of discontinuous polymer portions 11 with pores 12 therebetween and having a metal coating 13 deposited on top surface 10*a* of membrane 10. An oleophobic coating 14 is then deposited on the metal coating 13 and on the remainder of polymer portions 11. A textile shell material 23, such as woven silk or nylon, is adhered to the coated membrane by a discontinuous polyurethane adhesive 22, or a fusible non-woven adhesive such as Spunfab #EV3014 which is commercially available from Spunfab Corporation. Alternatively, the textile shell may be adhered to the coated microporous membrane either by direct heat fusion or by laminating with heat and pressure.

The textile employed for the shell material 23 should have the desired specific properties (e.g., IR 5 transparency, visible opacity, strength, etc.) and can be made of essentially any textile having these properties, in addition to silk or nylon. Preferably, a woven nylon taslite material is used such as that commercially available from Duro Corporation. Other textile shell materials which may be employed include synthetic (e.g., polyamide, polyester, polyolefin, acrylic) or natural (e.g., cotton, wool, silk, or blends) materials and these materials may be woven, non-woven, or knit. The textile shell material may also be coated with additional topical coatings to impart other desired characteristics such as flame retardancy, water repellency, electro-magnetic absorbency or reflectance. As an example, a topical coating material such as barium titanate may be employed to modify the radiant thermal characteristics of the laminated article. A liner fabric (not shown) such as knitted polypropylene can also be attached to the laminated article 20 in the same manner as the shell. The textile shell can be included in a garment construction such as a jacket, trousers, caps, socks, etc.

EXAMPLE 1

A microporous ePTFE membrane 0.001 inch thick of nominal 0.2$\mu$m pore size obtained from W. L. Gore & Associates, Inc. was metallized by vapor depositing aluminum by evaporation and condensation to an optical density of 3.0 density units (as determined on a Model TRX-N Densitometer of Tobias Assoc., Inc.). Specifically, aluminum wire was heated in an oxide crucible at a high vacuum ($2\times10^{-6}$ Torr) at about 1220° C. The aluminum vaporized. The ePTFE membrane with a polyester film backing to block entry of vapor on one side was passed over the crucible with the backing on the side away from the crucible. Vapor from the crucible rose to form the discontinuous coating on the adjacent side of the membrane. The coated membrane was then wound on a roll. After the backing was removed, the aluminized microporous membrane was brush coated with an aqueous fluoroacrylate microemulsion of a polyacrylate having side chains predominately of:

$$—C00—(CH_2)_2—(CF_2)—CF_3;$$

then dried and cured in an oven at 210° C. for two minutes. 6×9 inch samples of the fluoroacrylate coated metallized membrane were then laminated to a 2.7 ounce/yard woven nylon taslite shell material so that the aluminized surface was closest to the shell material. The shell material was bonded to the metallized membrane using a fusible non-woven adhesive (available as Spunfab #EV3014 from Spunfab Adhesive Fabrics Co. and pressed at 125° C. under a pressure of 2000 psi for 10 seconds to produce the laminated article.

To test infrared image suppression, a Hughes/Texas Instruments night vision system (dielectric bolometer—Part #6245935) was used. The dielectric bolometer recorded heat emission from a heated aluminum target block with an emissivity on one surface of 0.89 and an emissivity of 0.06 on the remaining 5 surfaces. This target was held at 30° C. using an internal heater. When the laminate was placed over the target, the image of the target was substantially reduced.

To test the emissivity of the laminate, a Devices and Services Model AE Emissometer was used. The laminate sample was placed on the heat sink of the device and the measuring head was placed on top of the laminate sample. The emissivity of the laminate described above was substantially reduced compared to typical laminates of similar construction.

EXAMPLE 2

An oleophobic metallized microporous ePTFE membrane was prepared as in Example 1. A piece of one ounce per square yard China silk was placed on a 6×9 inch rubber pad. A 6×9 inch piece of fusible, open, nonwoven adhesive (Spunfab #EV3014) was placed over the silk. A piece of the metallized film was placed over the adhesive layer with the metal side facing the adhesive. The resulting rubber pad/silk/adhesive/metallized membrane combination was laminated by press heating at 123° C. under a pressure of 2000 psi for 10 seconds. The laminated samples were then removed. IR image suppression properties and the emissivities of the samples were determined as in Example 1. The image and the emissivity were substantially reduced.

EXAMPLE 3

A microporous ePTFE membrane 0.001 inch thick of nominal 0.2 $\mu$m pore size obtained from W. L. Gore & Associates, Inc. was metallized by vapor depositing aluminum by evaporation and condensation on both sides to an optical density of 4.91 density units (as determined using a Model TRX-N Densitometer manufactured by Tobias Associates, Inc. Specifically, 0.15 grams of aluminum wire was placed in a tungsten basket under a 14 inch diameter bell jar. A 10 inch by 18 inch piece of ePTFE membrane was suspended around the inside surface of the bell jar. The bell jar was evacuated to a high vacuum ($2\times10^{-5}$ Torr) and 40 amps of current were applied across the tungsten basket, bringing its temperature to about 1220° C. and vaporizing the aluminum. Vapor from the basket rose to form the discontinuous coating on the adjacent side of the membrane. The ePTFE sample was then removed and the tungsten basket refilled with 0.14 grams of aluminum wire and the ePTFE sample flipped so that the previously uncoated surface was facing the tungsten basket. The metallization process was repeated and then the double metallized sample was removed. The aluminized microporous membrane was kiss roll coated with an aqueous fluoroacrylate microemulsion (BW1300) then dried and cured in an oven at 210° C. for two minutes. 6×9 inch samples of the flouroacrylate coated metallized membrane were then laminated to a 2.7 ounce/yard woven nylon taslite shell material so that the aluminized second surface was closest to the shell material. The shell material was bonded to the metallized membrane using a fusible non-woven adhesive (Spunfab #EV3014) and press heated at 125° C. under a pressure of 2000 psi for 10 seconds to produce the laminated article. IR image suppression properties and the emissivities of the samples were determined as in Example 1. The image and the emissivity were substantially reduced.

I claim:

1. An infra-red reflective material for covering objects, said material comprising a microporous, air-permeable, moisture vapor transmissive, water resistant and drapeable polymeric membrane having a top surface, a bottom surface, and pores therebetween; said membrane including:

(a) an infra-red reflective metal coating covering at least one of said membrane surfaces and exposed sub-surface portions thereof; in a manner such that the coating is disposed only discontinuously on at least one of said membrane top surface and exposed sub-surface; and (b) an oleophobic coating covering at least a portion of said metal coating.

2. An infra-red reflective material as recited in claim 1, wherein said oleophobic coating covers said top and bottom surfaces of said membrane and the walls forming the pores of said membrane.

3. An infra-red reflective material as recited in claim 1, wherein said oleophobic coating is an organic polymer that has fluorinated alkyl side chains in the recurring units of the polymer, which have terminal —$CF_3$ group.

4. An infra-red reflective material as recited in claim 1, wherein said metal coating is selected from the group consisting of aluminum, gold, silver, copper, zinc, cobalt, nickel, platinum, and alloys and combinations thereof.

5. An infra-red reflective material as recited in claim 1, wherein said microporous membrane is selected from the group consisting of an expanded polytetrafluoroethylene, polyethylene, polypropylene, polyurethane, and mixtures thereof.

6. An infra-red reflective material as recited in claim 5, further comprising an outer textile shell material adhered to said coated membrane.

7. An infra-red reflective material as recited in claim 6, wherein said outer textile shell is selected from the group consisting of silk, wool, cotton, polyamide, polyester, polyolefin, acrylic, nylon, and blends thereof.

8. An infra-red reflective material as recited in claim 1 forming at least part of one of a garment, or tenting material.

* * * * *